US005947624A

United States Patent [19]

Davignon

[11] Patent Number: 5,947,624

[45] Date of Patent: Sep. 7, 1999

[54] CAPILLARY FEED INK MARKER ASSEMBLY ADAPTED FOR MAKING ERASABLE MARKINGS ON THE SURFACE OF A SUBSTANTIALLY NON-POROUS MARKING SUBSTRATE

[75] Inventor: Paul A. Davignon, Uxbridge, Mass.

[73] Assignee: Avery Dennison Corporation, Pasadena, Calif.

[21] Appl. No.: 09/056,237

[22] Filed: Apr. 7, 1998

Related U.S. Application Data

[60] Provisional application No. 60/043,036, Apr. 7, 1997.

[51] Int. Cl.[6] ..... B43K 5/00

[52] U.S. Cl. ..... 401/202; 401/198

[58] Field of Search ..... 401/202, 18, 34, 401/131, 198, 199

[56] References Cited

U.S. PATENT DOCUMENTS 3,941,488 3/1976 Maxwell ..... 401/34

4,557,618 12/1985 Iwata et al. ..... 401/18

5,072,483 12/1991 Durand ..... 401/131

5,221,152 6/1993 Chuang ..... 401/202

*Primary Examiner*—David J. Walczak

*Attorney, Agent, or Firm*—Kriegsman & Kriegsman

[57] ABSTRACT

A capillary feed marker assembly for use with substantially non-porous marking substrates. In one embodiment, the capillary feed marker assembly comprises a capillary feed ink marker, the capillary feed ink marker comprising an elongated, hollow, cylindrical body having a front end and a rear end and being adapted to define a reservoir for holding a quantity of ink for making erasable markings on substantially non-porous substrates. In addition, the assembly comprises a cap assembly, the cap assembly being removably mounted on the capillary feed marker and comprising (i) an elongated cylindrical body having an open first end and an open second end, and (ii) a dry eraser mounted within the open first end of the cylindrical body and projecting out therefrom.

4 Claims, 1 Drawing Sheet

CAPILLARY FEED INK MARKER ASSEMBLY ADAPTED FOR MAKING ERASABLE MARKINGS ON THE SURFACE OF A SUBSTANTIALLY NON-POROUS MARKING SUBSTRATE

CROSS-REFERENCE TO RELATED APPLICATIONS

The present application claims the benefit under 35 U.S.C. 119(e) of U.S. Provisional Patent Application Ser. No. 60/043,036, filed Apr. 7, 1997, the disclosure of which is incorporated herein by reference.

BACKGROUND OF THE INVENTION

The present invention relates generally to ink markers and more particularly to erasable ink markers.

Ink markers for making markings that are erasable from the surface of a substantially non-porous substrate using a dry eraser are well-known. For example, in U.S. Pat. No. 3,949,132, inventors Seregely et al., which issued Apr. 6, 1976, and which is incorporated herein by reference, there is disclosed an ink composition for writing instruments having a porous writing point which will write satisfactorily on relatively smooth, hard surfaces (e.g., solid plastic surfaces) and which can easily be erased from said smooth, hard surfaces by merely wiping with a dry cloth or paper tissue.

Often, the substantially non-porous substrate is a white-board or glass substrate, and the dry eraser material, which is typically a piece of cloth or felt material, is mounted along the bottom of a base member having the size and shape of a conventional chalkboard eraser. Typically, a cap is removably mounted on the marking end of the marker to prevent the marker from drying-out.

Although markers of the type described above have proven to be generally adequate to enable people to make erasable markings on substantially non-porous substrates, the present inventor has observed that, in practice, many people use their fingers, instead of the above-described eraser, when they wish to erase only small areas or portions of such markings made on the above-described non-porous substrates. This practice of using one's fingers, which often undesirably results in a smearing of markings on the substrate and in a dirtying of the fingers used, is usually due to the inaccessibility of the eraser (which may become lost or separated from the substrate) and/or due to the fact that the eraser is often too big and bulky to make fine erasures.

In commonly-assigned PCT Application No. PCT/US93/10231, which was published May 11, 1994, and which is incorporated herein by reference, there is disclosed an erasable writing medium composition suitable for use in porous tip pens and roller-ball pens. Said erasable writing medium composition can be used to make markings on ordinary stationery-type paper that are erasable using an elastomeric eraser of the type typically found on the end of an ordinary pencil. The present assignee has sold capillary feed markers containing the ink of the aforementioned PCT application under the trademark OUTER LIMITS™ ERASERHEAD™ erasable marker. Said marker has been sold together with a cap that is removably mounted on the writing (or front) end of the marker and which also can be removably mounted on the rear end of the marker (for example, when the marker is being used), said cap having an elastomeric eraser removably mounted within its front end and projecting out therefrom.

Also of interest to the present invention is U.S. Pat. No. 4,940,628, inventors Lin et al., which issued Jul. 10, 1990, and which is incorporated herein by reference.

SUMMARY OF THE INVENTION

It is an object of the present invention to provide a new capillary feed ink marker assembly adapted for making erasable markings on the surface of a substantially non-porous marking substrate.

It is another object of the present invention to provide a capillary feed ink marker assembly as described above that overcomes at least some of the problems discussed above.

According to one feature of the present invention, there is provided a capillary feed marker assembly for use with substantially non-porous marking substrates, said capillary feed marker assembly being constructed according to the teachings of the present invention and comprising (a) a capillary feed ink marker, said capillary feed ink marker comprising an elongated, hollow, cylindrical body having a front end and a rear end and being adapted to define a reservoir for holding a quantity of ink for making erasable markings on substantially non-porous substrates; and (b) a cap assembly, said cap assembly being removably mounted on said capillary feed marker and comprising (i) an elongated cylindrical body having an open first end and an open second end, and (ii) a dry eraser mounted within the open first end of said cylindrical body and projecting out therefrom.

A principal benefit of the present invention is that fine erasures of markings on a substantially non-porous substrate can readily be made.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
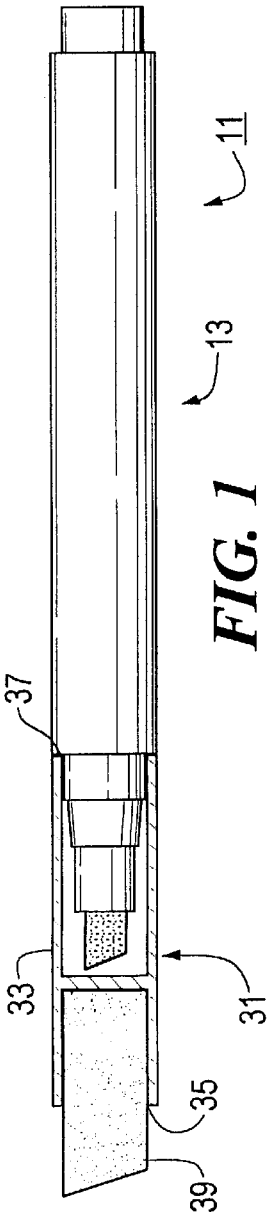
FIG. 1 is a side view, partly in section, of one embodiment of a capillary feed ink marker assembly constructed according to the teachings of the present invention, said capillary feed ink marker assembly being shown with the cap assembly mounted on the front end of the marker.

Referring now to FIG. 1, there is shown a side view, partly in section, of one embodiment of a capillary feed ink marker assembly constructed according to the teachings of the present invention, said capillary feed ink marker assembly being represented generally by reference numeral 11.

Figure 2:
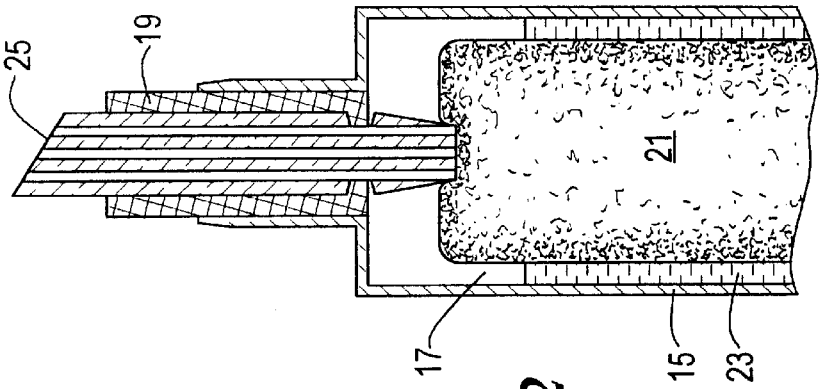
FIG. 2 is a fragmentary section view of the capillary feed ink marker of FIG. 1.

Assembly 11 comprises a capillary feed ink marker 13. Referring now to FIG. 2, marker 13 can be seen to include an elongated, hollow, cylindrical body 15. Body 15, which is shaped to define an ink reservoir 17, has an open end 19 for accessing reservoir 17. A filler 21 is disposed within reservoir 17, as is a quantity of ink 23 of the type that can make an erasable marking on a substantially non-porous substrate using a dry eraser. A nib 25 has a first end in contact with filler 21 and a second end which extends through open end 19.

Figure 3:
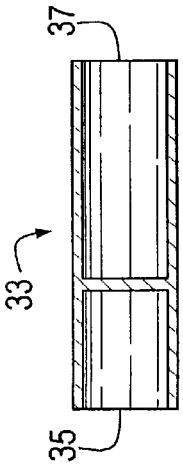
FIG. 3 is a section view of the cap shown in FIG. 1.
Figure 4:
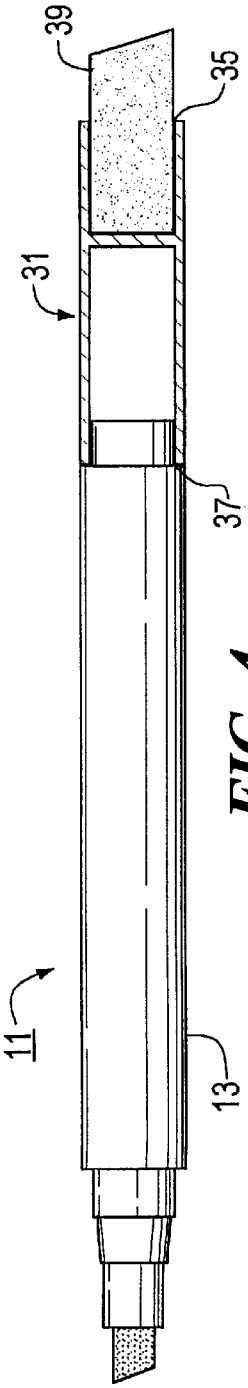
FIG. 4 is a side view, partly in section, of the capillary feed ink marker assembly of FIG. 1, said capillary feed ink marker assembly being shown with the cap assembly mounted on the rear end of the marker.

Referring back to FIG. 1, assembly 11 also comprises a cap assembly 31. Cap assembly 31 comprises a cap 33 (also shown in FIG. 3), cap 33 having an open front end 35 and an open rear end 37. Open rear end 37 is appropriately sized and shaped to be removably mounted on the front end of body 15, as well as on the rear end of body 15 as shown in FIG. 4. A dry eraser 39, which may be made of felt, foam or any similarly suitable dry eraser material of type conventionally used to erase markings from substantially non-porous substrates, is mounted in open front end 35 of cap 33 and projects outwardly therefrom. Because cap 33 can be removably mounted on either the front end or the rear end of marker 11 and because eraser 39 projects away from marker 11 when cap 33 is mounted thereon, eraser 39 is accessible for erasing regardless of which end of marker 11 cap 33 is mounted on.

Marker 11 can be used in the conventional manner to make markings on substantially non-porous substrates. When erasure (particularly fine erasure) is desired, eraser 39—either mounted on one of the two ends of marker 11 or separate therefrom—may be used to make erasures.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A capillary feed marker assembly for use with substantially non-porous marking substrates, said capillary feed marker assembly comprising:

(a) a capillary feed ink marker, said capillary feed ink marker comprising an elongated, hollow, cylindrical body having a front end and a rear end and being adapted to define a reservoir for holding a quantity of ink for making erasable markings on substantially non-porous substrates;

(b) a quantity of ink disposed within said reservoir, said ink being capable of making markings on said substantially non-porous substrate that are erasable with a dry eraser; and (c) a cap assembly, said cap assembly being removably mounted on said capillary feed marker and comprising (i) an elongated cylindrical body having an open first end and an open second end, and (ii) dry eraser means for erasing markings made on said substantially non-porous substrate using said quantity of ink, said dry eraser means being mounted within the open first end of said cylindrical body and projecting out therefrom.

2. The capillary feed marker assembly as claimed in claim 1 wherein said open second end of said elongated cylindrical body is removably mountable on said front end of said capillary feed ink marker.

3. The capillary feed marker assembly as claimed in claim 1 wherein said open second end of said elongated cylindrical body is removably mountable on said front end and said rear end of said capillary feed ink marker.

4. The capillary feed marker as claimed in claim 1 wherein said dry eraser means comprises a piece of felt.

* * * * *